United States Patent [19]

Hohnerlein, Jr. et al.

[11] 4,332,622

[45] Jun. 1, 1982

[54] DIRECT PRODUCTION OF A PURE SUGAR PRODUCT FROM CANE JUICE

[75] Inventors: Otto G. Hohnerlein, Jr., Savannah; Willie E. Smith, Jr., Tybee Island; Nicholas T. Rimedio, Sr., Savannah, all of Ga.

[73] Assignee: Savannah Foods & Industries, Inc., Savannah, Ga.

[21] Appl. No.: 181,234

[22] Filed: Aug. 25, 1980

[51] Int. Cl.[3] ..... C13K 3/00; C13D 3/14

[52] U.S. Cl. ..... 127/41; 127/46.1; 127/48

[58] Field of Search ..... 127/41, 48, 46 A, 46 B, 127/46 R, 51, 52, 55, 1

[56] References Cited

U.S. PATENT DOCUMENTS

| | | | |
|---|---|---|---|
| 118,524 | 8/1871 | Garton | 127/41 |
| 498,000 | 5/1893 | Wohl et al. | 127/41 |
| 1,532,271 | 4/1925 | Slay | 127/41 |
| 2,261,919 | 11/1941 | Pittman et al. | 127/41 |
| 2,568,925 | 9/1951 | Mills | 127/41 |
| 2,712,552 | 7/1955 | Ventre | 127/41 X |
| 2,988,463 | 6/1961 | Vajna | 127/46 A |
| 3,290,173 | 12/1966 | Marino | 127/41 |
| 3,298,865 | 1/1967 | Bode | 127/41 X |
| 3,313,655 | 4/1967 | Miyahara et al. | 127/41 X |
| 3,475,216 | 10/1969 | Walon | 127/41 X |
| 3,480,476 | 11/1969 | Abbott | 127/41 X |
| 3,511,705 | 5/1970 | Haack et al. | 127/41 |
| 3,785,863 | 1/1974 | Devillers et al. | 127/46 A X |
| 3,812,010 | 5/1974 | Nitsch | 127/41 X |
| 4,140,541 | 2/1979 | Popper | 127/46 A |
| 4,196,017 | 4/1980 | Melville et al. | 127/41 |

OTHER PUBLICATIONS

Meade-Chen; Cane Sugar Handbook; 10th Ed.; pp. 359-377; 1977; John Wiley & Sons Inc.

*Primary Examiner*—Kenneth M. Schor

*Attorney, Agent, or Firm*—Cushman, Darby & Cushman

[57] ABSTRACT

This invention provides a method for the purification of cane juice to produce a finished product of very high quality. This purification process and general concept differs from existing cane juice purification schemes in that traditional methods either produce crystalline raw sugar or a liquid product commonly referred to as high test or fancy molasses. The processing of the cane juice generally comprises the steps of:

(a) pretreating the cane juice to remove any soil or foreign matter and substantially reducing the total cation concentration of the cane juice;

(b) hydrolyzing the pretreated cane juice to a desired degree;

(c) purifying the hydrolyzed juice without precipitation or crystallization of raw sugar by subjecting the solution obtained in step (b) to gross demineralization and decolorization; and (d) concentrating the purified solution obtained in step (c) to obtain a pure odorless finished sugar product which meets or exceeds existing standards for pure sugar.

Preferably, these steps are carried out by:

(e) acidifying fresh raw sugar cane juice to a pH lower than its naturally occurring pH (e.g. a pH of 2 to 5 or less) and heating the acidified juice at a temperature ranging from between about 40° and 95° C. (preferably 60° to about 80° C. for a period of time sufficient to convert the desired amount of cane juice to glucose and fructose;

(f) adjusting the pH of the product of step (e) to about 5.2 to form a floc;

(g) separating the floc from the juice and passing the juice through a filter aid to form a clear solution;

(h) subjecting the clear solution to gross demineralization and decolorization by passing the solution sequentially through a decolorizer cation and anion exchange resin;

(i) passing the solution obtained in step (h) through a carbon, bone char and/or carbonaceous adsorbant resins filter to remove cane flavors and odors;

(j) passing the effluent obtained in step (i) over a cation and anion exchange resin; and (k) evaporating or concentrating the effluent of step (j) to the desired solids level whereby a clear, colorless and odorless liquid finished product is obtained which meets or exceeds standards for pure sugar solutions.

15 Claims, No Drawings

DIRECT PRODUCTION OF A PURE SUGAR PRODUCT FROM CANE JUICE

BACKGROUND OF THE INVENTION

Historically, the sugar cane plant has been cultivated for its sweetness. This sweetness is a result of the relatively high concentration of sucrose in the plant. Throughout history, man has worked to extract and then purify the sucrose contained in the juice by using various methods considered to be the best available at the time as evidence, for example, U.S. Pat. Nos. 118,524; 498,000; 1,532,271; 2,568,925; 2,712,552; 3,313,655; 3,511,705 and 3,812,010.

Today, the juice is extracted from the plant and subsequently processed using techniques which will maximize the yield of sucrose. In order to accomplish this, the sugar industry has attempted to minimize sucrose inversion in all phases of their operations. Inversion is the common term used to describe the chemical breakdown of sucrose, a disaccharide, into its corresponding mono-saccharides of glucose and fructose. Traditionally, cane planting, harvesting, handling and transporting along with juice extraction and purification is accomplished with the intent of minimizing sucrose inversion. The importance of this effort is realized since the glucose and fructose produced by such inversion can not be crystallized from the juice and therefore, will be discharged from the process as a by-product. In addition, these compounds will increase the sucrose solubility in the by-product resulting in even greater sucrose loss. The by-product of traditional cane juice purification is referred to as Blackstrap Mollasses.

The second product currently being manufactured from sugar cane juice is "High Test" or "Fancy Molasses". The production of the product from cane juice is a very old process. The basic steps in its manufacture include clarification with lime, filtration then evaporation to a solids level of about 60%. The dark, aromatic smelling juice, or syrup as it is referred to at that solids level, is then intentionally inverted to a predetermined point and evaporated to 85% solids. A typical analysis of this type product would be: 85% total solids in solution, 27% sucrose on a dry basis, 50% invert sugars on dry basis, 2.25% ash on a dry basis, and 5.75% organic non-sugars on a dry basis. High Test or Fancy Molasses is produced instead of raw sugar and never in conjunction with it.

It is therefore a primary object of the present invention to provide a process of producing a finished sugar product directly from cane juice that will meet or exceed existing standards for pure sugar.

A further object of the present invention is to provide a process for purifying carbohydrates contained in cane juice without manufacturing raw sugar and molasses.

These and other objects of the present invention will be more apparent from the discussion which follows.

SUMMARY OF THE INVENTION

The present invention further relates to a process for producing a finished sugar product directly from cane juice. The invention provides for the purification of carbohydrates in cane juice and is designed to by-pass the traditional manufacture of the intermediate product, raw sugar. In so doing, the invention by-passes the formation of the by-product, Blackstrap Molasses, which contains carbohydrates that are more valuable in the purified form.

A key feature of the present invention is the preparation of a finished product directly from cane juice as a raw material without intermediate processing of or formation of raw (i.e. impure) sugar or molasses. The finished sugar solution which results is one that will meet or exceed all existing standards for pure sugar solutions.

While reference is made herein to cane juice as the raw or starting material, it is to be understood that the term is, for the purpose of the present application, inclusive of such materials as sugar cane juice, maple, sorghum and the like.

The process steps of the present invention generally comprise:

(a) Pretreatment of the cane juice;
(b) Controlled hydrolysis;
(c) Purification; and
(d) Evaporation or concentration.

In its broader aspects, the present process avoids the concurrent production of raw sugar and/or molasses by:

(a) pretreating the cane juice to remove all soil or foreign matter and substantially reducing the total cation concentration of the cane juice;
(b) hydrolyzing the pretreated cane juice to a desired degree;
(c) purifying the hydrolyzed juice without precipitation or crystallization of raw sugar by subjecting the solution obtained in step (b) to gross demineralization and decolorization; and
(d) concentrating the purified solution obtained in step (c) to obtain a pure odorless finished sugar product which meets or exceeds existing standards for pure sugar.

The present invention yet further provides a process for the production of a liquid finished product composed chiefly of glucose and fructose directly from fresh sugar cane juice which comprises the steps of:

I. Pretreating and hydrolyzing cane juice by:

(a) acidifying fresh raw sugar cane juice to a pH lower than its naturally occurring pH (e.g. pH of 2.5 or less) and heating the acidified juice at a temperature ranging from between 40° C. and 95° C. (preferably about 60° to about 80° C. for a period of time sufficient to convert the desired amount of sucrose (e.g. from one to 20 hours to achieve a conversion of 95%+)
(b) adjusting the pH of the product of step (a) to about 5.2 to form a floc.

II. Purifying and hydrolyzing by:

(c) separating the floc from the juice and passing the juice through a filter aid to form a clear solution;
(d) subjecting the clear solution to gross demineralization and decolorization by passing the solution sequentially through a decolorizer cation and anion exchange resin;
(e) passing the solution obtained in step (d) through a bone char filter to remove cane flavors and odors; and
(f) passing the effluent obtained in step (e) over a cation and anion exchange resin.

III. Concentration by:

(g) concentrating the product of step (f) to at least about 65%, and preferably at least about 70% solids to obtain a clear, colorless, odorless syrup product.

The acidification step (a) may conveniently be carried out by the addition of phosphoric or sulfuric acid followed by heating to a temperature between about 60° and 80° C. for a period of time sufficient to convert the desired conversion, generally about 95% (2 to 4 hours).

Adjustment of the pH in step (b) may conveniently be carried out with addition of the required amount of lime, ammonium hydroxide, sodium hydroxide or mixtures thereof.

Separation of the floc from the juice can be accomplished by a variety of means. For example, separation may be accomplished by gravimetric (i.e. settling) or mechanical means (i.e. centrifuging). Subsequently the supernatant may be passed through a filter bed, e.g., diatomaceous earth, to form a clear solution free of colloidal particles.

DETAILED DESCRIPTION OF THE INVENTION

The processing steps of the present invention (i.e. pretreatment, controlled hydrolysis, purification and evaporation) may be carried out batchwise or continuously in the processing of fresh thin juice from cane.

PRETREATMENT

Pretreatment is a very essential part of this process due to the nature of the remaining process operations. The cleaner the pretreated cane juice, the more economical the remainder of the process becomes. The economics of pretreatment can easily be judged against the effect the resulting solution will have on the economics of the remainder of the process.

The object of the pretreatment step is to remove any soil, dirt, or foreign matter from the original sugar cane juice and to substantially reduce the total cation concentrations of the original sugar cane juice. By substantially reducing the cation concentration is meant to refer to at least a 20% reduction and preferably at least about 50%. In addition, such treatment substantially reduces the color and organic non-sugar content of the original sugar cane juice and further results in a decrease in the amount of turbidity or suspended particulate in the original sugar cane juice, as well as a decrease in the polysaccharide content.

A variety of procedures may be employed as standard sugar technology defecation methods described in "Cane Sugar Handbook", Mende & Chen, 10th Edition, Chapters 7 and 8.

There are a number of alternative means for pretreatment which include at least one of the following procedures:

(1) Acidifying the juice to a pH lower than its naturally occurring pH, heating the juice to a temperature of 40° C. to 95° C., then adding a quantity of lime sufficient to neutralize the solution to a pH of 4.5 to 5.4, and preferably 4.8 to 5.2 (most suitably about 5.2).

(2) Enzymatic treatment to reduce the polysaccharide content of the original cane juice. For example, one may utilize invertase to achieve hydrolysis, proteinase to reduce protein content, pectinase to reduce pectins, or dextranase to reduce dextrans among others.

(3) Floculation with commercial polyelectrolytes or floculants may be used to aid in the separation of any floculation that is produced during pretreatment; and (4) Treatment with chemical agents, either solid, liquid or gaseous may be added to the solution, thus reacting with the impurity or catalizing the conversion of the impurities to a form which is more easily removed in future steps. For example, sodium hypochlorite, chlorine gas or sulfur dioxide may be used.

CONTROLLED HYDROLYSIS

In producing a finished product of sufficient purity so as to meet or exceed any or all standards for pure sugar solutions, hydrolysis is not an essential step. The nature of the finished product desired determines to what degree hydrolysis should be accomplished. The following possibilities are offered as potential levels of hydrolysis.

(1) Completely hydrolyze all of the sucrose (i.e. hydrolyze at least 95%, and preferably 99%);

(2) Partially hydrolyze the sucrose to a pre-determined invert sugars content;

(3) Operate the system so as to minimize hydrolysis, (i.e. less than 10% hydrolysis) so as not to intentionally hydrolyze any of the sucrose.

There are a variety of methods by which hydrolysis can be accomplished. Hydrolysis can be accomplished to any degree by adjusting the pH, temperature, and holding time in the pretreatment steps, by adjusting the holding time and temperature of the cation exchanger effluent, by the use of enzymes or by the use of microorganisms. If by the addition of a chemical agent, the pH of the solution is lowered to a level sufficient to cause hydrolysis, then hydrolysis may be accomplished to any degree by controlling the temperature and holding time of the solution. Maximum hydrolysis (i.e. greater than 95%) is achieved by use of low pH (e.g. below 4.3 and preferably 2.5 or less), high temperatures (e.g. 80° to 95° C.) for sufficient periods of time to achieve conversion.

In the case where minimum hydrolysis is desired, i.e. no intentional hydrolysis is desired, the temperatures and holding times should be kept to a minimum where applicable. The resulting product may be a solid when concentrated, which if desired may be granulated.

In many instances, hydrolysis is carried out simultaneously with pretreatment.

PURIFICATION

Purification is needed to effectively remove all remaining impurities so as to produce a finished sugar that meets or exceeds all existing standards for pure sugar. These standards specify that the sugar should be practically free of color, inorganic ash, organic non-sugars, undesirable odors and flavors, and visual particulate matter or sediment.

The following procedure is offered as a guideline as to the extent of the treatment necessary to purify the sugar solution. While this is by no means the only way to achieve purification, it is believed that others will only be modifications of this scheme. This scheme consists of (1) Gross decolorization by use of decolorizing ion exchange resins;

(2) Filtration of the sugar solution to remove any visual particulate or sediment;

(3) Treatment of the sugar solution with animal bone char, commercial carbons (granular or powdered) or carbonaceous adsorbent resins;

(4) Passing the solution over cation/anion exchangers.

It is important that one avoid crystallization during purification and thus the concurrent formation of raw sugar or molasses.

EVAPORATION OR CONCENTRATION

The evaporation or concentration step is carried out so as to increase the solids level of the pure sugar to any desired degree and in general is carried out to achieve a solids level of at least 65% and preferably at least 70% in the finished product. In those instances where the cane juice has been completely hydrolyzed, the finished product will be in the form of a clear, colorless liquid. On the other hand, where hydrolysis is controlled to less than 10%, the finished product may be a solid when concentrated.

Evaporation can be accomplished by conventional known techniques. There are several methods available for commercial large scale evaporation, all of which should be acceptable, including but not limited to liquid concentration and spray drying.

The following examples are offered in order to more fully illustrate the present invention but are not to be construed as limiting the scope thereof.

EXAMPLE ONE

Raw sugar cane juice which had been screened to remove coarse impurities was simultaneously pretreated and hydrolyzed by acidifying to a pH of 2.5 with 85% $H_3PO_4$, heated and maintained at 80° C. for 14 hours. The solution was allowed to cool for 2 hours. The impurities had coagulated at this point but the solution was still turbid. The temperature had fallen to approximately 60° C. so it was reheated to 75° C. and process lime slurry was added to a 5.2 pH. A very heavy floc formed at this time. A commercial polyelectrolyte was used to aid in coagulation of the floc particles. This solution was allowed to settle for 1.5 hours with the heat off. At this point the solution was decanted and strained through cloth towels. The solution was then purified by filtering through a commercial filter aid (John Mansville SuperCell) using a sweetland press cloth for backing and air pressure to force the solution through the filter aid. This process did render the juice sparkling in appearance and registered turbidity readings of 3 or less J.T.U. on a Monitec Model 50 Turbidimeter.

This clear solution was further purified by passing through the following Ion Exchange system:

(1) Decolorizer (IRA 900 Rohm & Haas 1" $\phi\times30$" or 0.385 l of resin regenerated with 616 ml of 10% NaCl solution)

(2) Cation (C-252 Rohm & Haas 1" $\phi\times30$" or 0.385 l of resin regenerated with 350 ml of 10% $H_2SO_4$ solution)

(3) Anion (A-340 Diamond Shamrock 1" $\phi\times36$" or 0.463 l of resin regenerated with 283 ml of 5% $NH_3$ solution)

(4) Bone Char (Service char from Refinery Char Kiln, 8 columns 1" $\phi\times40$"=4.116 l)

(5) Cation (C-252 Rohm & Haas 1" $\phi\times30$" or 0.385 l of resin regenerated with 350 ml of 10% $H_2SO_4$ solution)

(6) Anion (A-340 Diamond Shamrock 1" $\phi\times36$" or 0.463 l of resin regenerated with 283 ml of 5% $NH_3$ solution)

The flow was adjusted so that it never exceeded 0.02 gallons per minute per cubic foot of char. On this particular system, the flow was not greater than 10 ml per minute.

A duplicate decolorizer, cation and anion column were held ready so that when one set of primary ion exchange units were exhausted, a second set could be put on line immediately and the first set could be regenerated and held ready again.

This system was operated continuously for a period of 80 hours, which involved five cycles for the primary ion exchangers.

The product was collected in one liter divisions from the effluent of the secondary anion column and was frozen to prevent spoilage until it was evaporated at which time the solids were raised to approximately 70 Brix.

EXAMPLE TWO (COMPARATIVE)

The following procedures were carried out in an effort to duplicate the method described by Wiliam Garton in U.S. Pat. No. 118,524.

To 600 grams of sugar cane juice was added 60 grams of 6 N sulphuric acid. The acidified solution was rapidly heated to a temperature of 70°–95° C. for a period of three hours. The pH of the thin juice prior to acidification was 5.7, and after addition of the acid 0.7.

After heating for three hours to complete conversion of the juice, 30 grams of finely ground bone char was added with heating and agitation for 30 minutes. Thereafter, there was added sufficient lime to raise the pH to 7.0. The solution was filtered and passed over bone char to obtain a dark amber liquid having poor taste characteristics. The amber liquid had a conductivity of 8500 and a color (wavelength of 560 nanometers) of 844. Upon standing for three days, a murky precipitate formed.

EXAMPLE THREE (COMPARATIVE)

The procedure of Example Two was repeated except the pH of the acidified solution was raised to 5.2 by the adding of lime. The product liquid was also dark amber in color and possessed poor taste characteristics. The product had a conductivity of 7800 and a color index of 834.

The experimental procedure and example given, herein, are means to reach the desired finished product. It is easily recognized that slight variances could be made in the above mentioned outline without deviating from the desired ends which were sought with this.

The invention having been thus described, it will be appreciated that same may comprise, consist or consist essentially of the hereinabove recited steps and materials.

What is claimed is:

1. A process for the production of a finished sugar product composed chiefly of glucose and fructose directly from cane juice without the concurrent production of raw sugar, molasses, or mixtures thereof, said process comprising the steps of:

(a) acidifying the cane juice to a pH less than its naturally occurring pH and heating the acidified juice at a temperature ranging from between about 40° to about 95° C. for a period of time sufficient to convert at least 95% of sucrose to glucose and fructose;

(b) adjusting the pH of the product of step (a) to about 5.2 to form a floc;

(c) separating the floc from the juice and passing the juice through a filter aid to form a clear solution;

(d) subjecting the clear solution to demineralization and decolorization by passing the solution sequentially through a decolorizer resin, cation resin, and anion exchange resin, without the concurrent production of raw sugar, molasses or mixtures thereof;

(e) passing the solution obtained in step (d) through a bone char filter to remove cane flavors and odors;

(f) passing the effluent obtained in step (e) over a cation exchange resin, and an anion exchange resin; and (g) concentrating the effluent to at least about 70% solids whereby a clear, colorless, and odorless finished liquid product is obtained which is substantially free from impurities.

2. A process according to claim 1 wherein step (a) is carried out by the addition of phosphoric or sulfuric acid to the cane juice and thereafter heated for a period of time sufficient to convert at least 99% of the sucrose present in said cane juice.

3. A process according to claim 1 or 2 wherein the pH in step (b) is adjusted by the addition of lime, ammonium hydroxide, sodium hydroxide or mixtures thereof.

4. A process according to claim 3 wherein step (c) comprises centrifuging the product obtained from step (b) and thereafter passing the supernatant through a membrane or bed of diatomaceous earth to form a clear solution free of colloidal particles.

5. A process according to claim 1 wherein acidification is carried out by the addition of phosphoric or sulfuric acid.

6. A process according to claim 1 wherein the pH is adjusted by the addition of lime, ammonium hydroxide, sodium hydroxide, or mixtures thereof.

7. A process according to claim 1 wherein the floc may be separated by gravity or mechanically.

8. A process according to claim 1 wherein the cane juice is filtered by passing through a membrane filter or bed of diatomaceous earth to form a clear solution free of colloidal particles and turbidity.

9. A process according to claim 1 wherein concentration is accomplished by spray drying.

10. A process according to claim 1 wherein the cane juice is sugar cane juice.

11. A process according to claim 1 wherein the cane juice is hydrolyzed to achieve at least a 99% conversion.

12. A process for the production of a pure sugar product composed chiefly of glucose and fructose directly from cane juice without the concurrent production of raw sugar, molasses, or mixtures thereof, said process comprising the steps of:

(a) acidifying the cane juice to a pH less than its naturally occurring pH and heating the acidified juice at a temperature ranging from between about 40° to about 95° C. for a period of time sufficient to convert at least 95% of sucrose to glucose and fructose;

(b) passing the juice of step (a) through a filter aid to form a clear solution;

(c) subjecting the clear solution to demineralization and decolorization by passing the solution sequentially through a decolorizer resin, cation exchange resin, and anion exchange resin, without the concurrent production of raw sugar, molasses or mixtures thereof;

(d) filtering the solution to remove cane flavors and odors; and (e) concentrating the effluent to at least about 70% solids whereby a clear, colorless, and odorless finished liquid product is obtained which is substantially free from impurities.

13. A process according to claim 12 further comprising the steps of adjusting the pH of the product of step (a) to form a floc and separating the floc from the juice.

14. A process according to claim 12 wherein step (d) is practiced by passing the solution through a bone char filter.

15. A process according to claim 12 further comprising the step of passing the solution of step (b) through a bone char filter.

* * * * *